United States Patent [19]

Lohnherr et al.

[11] Patent Number: 4,889,289

[45] Date of Patent: Dec. 26, 1989

[54] METHOD AND APPARATUS FOR CRUSHING MATERIAL FOR GRINDING

[75] Inventors: Ludger Lohnherr, Oelde; Walter Holz, Beckum, both of Fed. Rep. of Germany

[73] Assignee: Krupp Polysius AG, Fed. Rep. of Germany

[21] Appl. No.: 191,049

[22] Filed: May 6, 1988

[30] Foreign Application Priority Data

May 27, 1987 [DE] Fed. Rep. of Germany ..... 3717976

[51] Int. Cl.[4] ..... B02C 23/32

[52] U.S. Cl. ..... 241/18; 241/24; 241/29; 241/80; 241/152 A

[58] Field of Search ..... 241/80, 152 A, 93, 24, 241/29, 79.1, 117–121, 33, 18, 76, 77, 78

[56] References Cited

U.S. PATENT DOCUMENTS 3,951,347 4/1976 Tiggesbaumker et al. .... 241/79.1 X
4,113,187 9/1978 Hoppen et al. ..... 241/80 X
4,690,335 9/1987 Allers et al. ..... 241/152 A X

FOREIGN PATENT DOCUMENTS 231447 11/1985 Japan ..... 241/29

*Primary Examiner*—Mark Rosenbaum
*Attorney, Agent, or Firm*—Learman & McCulloch

[57] ABSTRACT

The invention relates to a method and to apparatus for crushing brittle material for grinding using a roller mill and a material bed roll mill for crushing the material for grinding falling downwards over the edge of the grinding track before it is delivered to the sifter. By the use of a material bed roll mill a considerable increase in the throughput capacity of the apparatus and a significant saving of energy can be achieved.

14 Claims, 2 Drawing Sheets

METHOD AND APPARATUS FOR CRUSHING MATERIAL FOR GRINDING

The invention relates to a method and apparatus for crushing brittle material for grinding.

It is frequently desired to increase significantly the throughput capacity of apparatus of the aforementioned type (containing a roller mill, sifter and bucket elevator).

The object of the invention, therefore, is to provide a method and apparatus improved in such a way that the throughput capacity of the apparatus is significantly increased with comparatively low expenditure on plant.

This object is achieved according to the invention by the provision of a roll mill between the roller mill and bucket elevator. Advantageous embodiments also form parts of the invention as set forth hereinafter.

THE DRAWINGS

One embodiment of the invention is shown in the drawings, in which.

DETAILED DESCRIPTION

Figure 1:
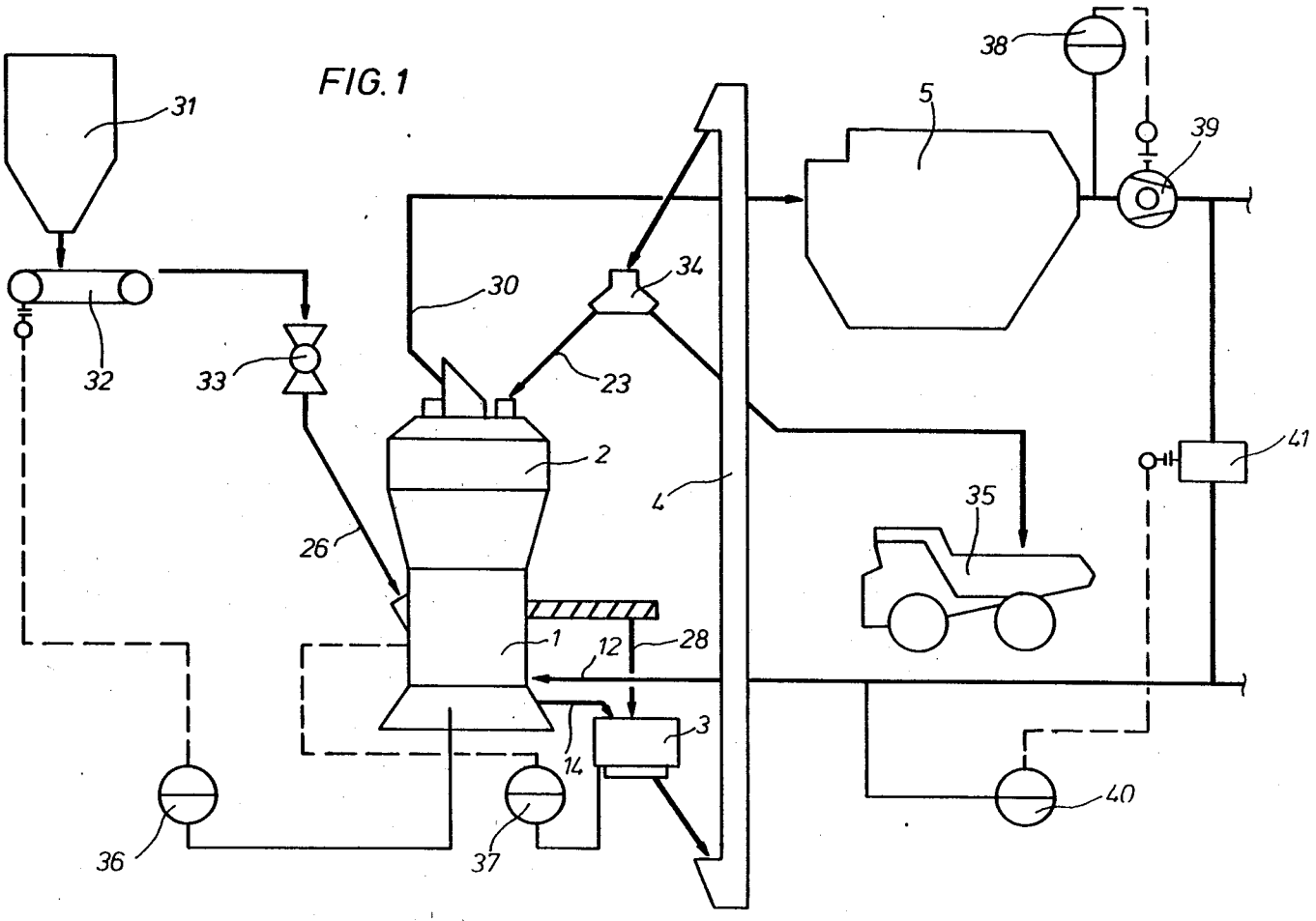
FIG. 1 shows an overall diagram of apparatus according to the invention.

The apparatus shown in FIG. 1 for crushing brittle material for grinding, for example cement clinker, contains a roller mill 1, a sifter 2 arranged above it, a material bed roll mill 3, a bucket elevator 4, a fines separator 5 and a plurality of further parts which will be described in connection with the functioning of the apparatus.

Figure 2:
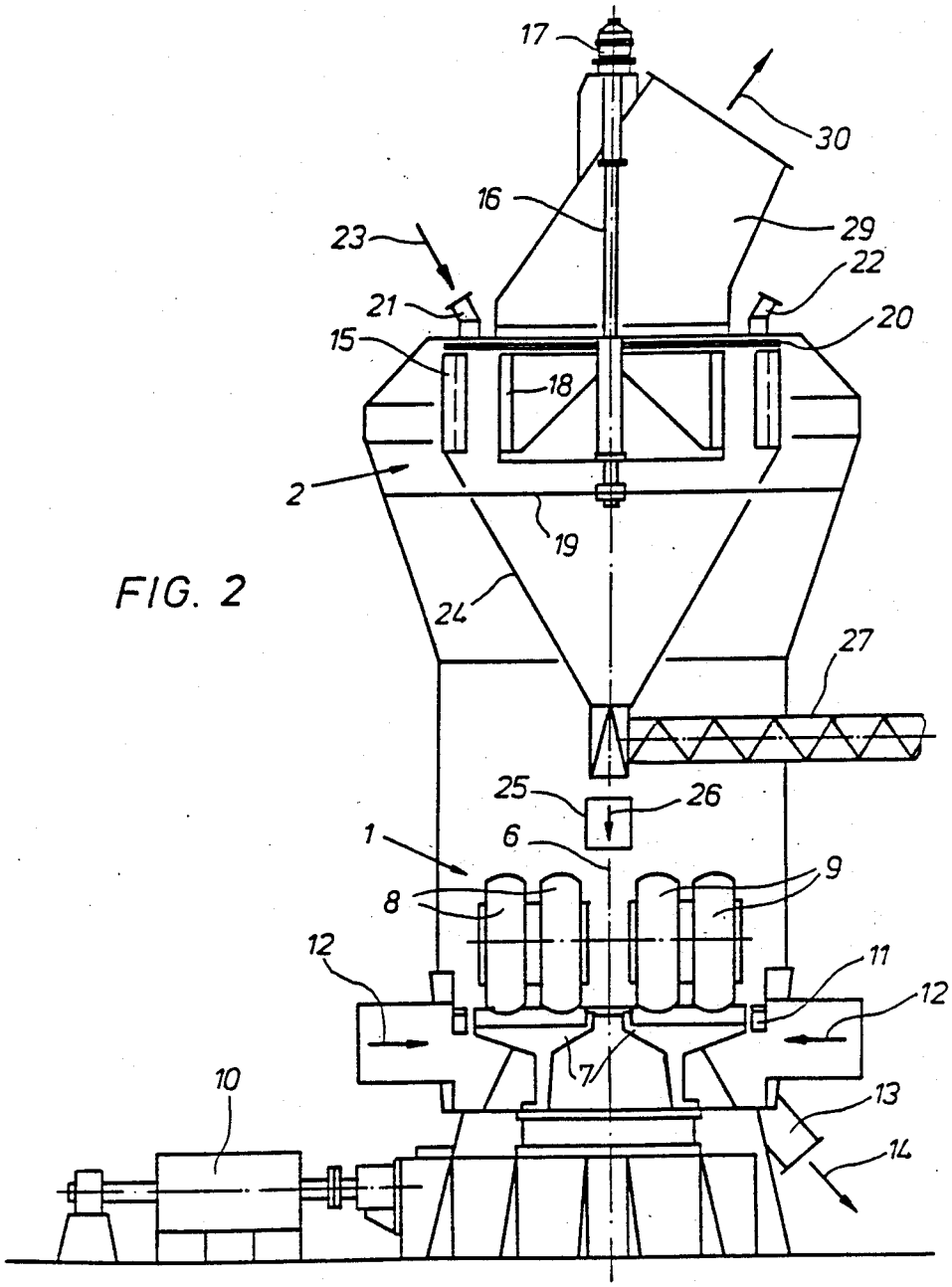
FIG. 2 shows a section through the roller mill and sifter of the apparatus according to FIG. 1.

The roller mill 1 which can be seen in detail in FIG. 2 has a horizontal grinding track 7 which runs around the vertical axis 6 and on which grinding rollers 8, 9 press.

The grinding track 7 is driven by a drive motor 10 and a gear unit which is not shown in detail in the support of the roller mill 1.

An adjustable nozzle ring 11 through which an air stream (arrow 12) is delivered to the grinding track 7 is arranged on the periphery of the grinding track 7.

The material for grinding which is not yet sufficiently crushed falls downwards over the edge of the grinding track 7 (i.e. against the air stream) and passes via a chute 13 to the roll mill 3 (arrow 14).

The dynamic sifter 2 arranged above the roller mill 1 contains a fixed (advantageously adjustable) guide vane ring 15 and sifting cage 18 which is driven by a motor 17 via a shaft 16. The shaft is mounted at its lower end by means of radial struts 19.

The shaft 16 also has above the sifting cage 18 a distributor plate 20 to which the material to be sifted is delivered (arrow 23) from the bucket elevator 4 via short pipes 21, 22.

Below the guide vane ring 15 the sifter 2 has a hopper 24 through which the tailings can be returned to the grinding track 7 of the roller mill 1. The raw material is delivered to the grinding track 7 through an opening 25 (arrow 26).

A tailings screw 27 which can be regulated in speed is also connected to the lower end of the hopper 24 and delivers an adjustable proportion of the tailings direct to the roll mill 3 (arrow 28 in FIG. 1).

The air stream conducting the fines is drawn off from the sifter 2 via a pipe 29 (arrow 30).

The apparatus functions using the method according to the invention as follows:

The material for grinding which is first to be crushed is delivered to the roller mill 1 from a silo 31 via a proportioning belt scale 32 and an air excluding device 33. The material for grinding which has been sufficiently crushed on the grinding track is conveyed to the sifter 2 by the air stream. The fines leaving the sifter together with the air stream are precipitated in the separator 5.

A proportion of the tailings precipitated in the sifter 2 is returned to the grinding track 7 of the roller mill 1. A further, adjustable proportion of the tailings passes via the tailings screw 27 direct to the roll mill 3. The material for grinding falling downwards over the edge of the grinding track 7 is also delivered to this material bed roll mill. In the roll mill 3, the rolls of which are pressed against one another with a high pressure, the material undergoes material bed crushing with noticeable formation of agglomerates.

The material for grinding discharged from the roll mill 3 is conveyed upwards via the bucket elevator 4 and by means of a valve 34 is either delivered to the distributor plate 20 of the sifter 2 or to some other application (vehicle 35) (if required, this stream of material delivered via the bucket elevator 4 can also be divided).

The agglomerates of material for grinding which are formed in the roll mill 3 undergo disagglomeration on the rotating distributor plate 20 of the sifter 2. The agglomerates which are broken up in this way are thus delivered evenly to the sifting air.

The finished material which is already present after passing through the roll mill 3 is thus directly sifted and no longer returned to the roller mill 1. In this way the roller mill 1 is substantially relieved of strain.

As a result there is a considerable reduction in the pressure loss for the roller mill, which leads to a marked saving in energy in the pneumatic conveying of the material for grinding.

It is also a particular advantage that the material recirculated by the bucket elevator is already largely dried, since in the roll mill 3 the material for grinding falling downwards over the edge of the grinding track 7 is ground together with tailings (delivered via the tailings screw 27) which are already largely dried.

The apparatus is controlled essentially by the use of the following control circuits:

A first control circuit (regulator 36) regulates the quantity delivered to the roller mill 1 via the proportioning belt scale 32 as a function of the drive power of the roller mill 1.

A second control circuit (regulator 37) keeps the electric current consumption of the material bed roll mill constant by appropriate regulation of the cross-section of the adjustable nozzle ring 11 and thus the gas speed in the nozzle ring (the proportion of material for grinding falling downwards against the air stream, and with it the quantity of material recirculated by the bucket elevator, alters with the gas speed in the nozzle ring).

A third control circuit (regulator 38) keeps the quantity of gas drawn through the apparatus constant by influencing the speed of a fan 39 arranged after the fines separator 5.

A fourth control circuit (regulator 40) controls a circulating air valve 41 and thus keeps the negative pressure prevailing in the air stream before the roller mill 1 constant.

Only a proportion of the tailings precipitated in the sifter 2 is advantageously removed via the tailings screw 27 and delivered direct to the material bed roll mill 3. This part quantity is regulated by adjusting the speed of the tailings screw 27 which operates as an overflow screw. The quantity removed can be weighed and thus the speed of the screw can be controlled.

The use of pneumatic means for conveying the material for grinding in a conventional grinding apparatus using a roller mill takes a comparatively large proportion of the total energy used for grinding. By means of the invention the material for grinding falling downwards through the nozzle ring 11 is subjected to further crushing by means of the material bed roll mill 3 and delivered via the bucket elevator 4 to the sifter 2. Up to 50% finished material is contained in this material for grinding which is delivered directly to the sifter (depending upon the type of material to be ground). This proportion of material is thus withdrawn from the pneumatic conveying. This results in a pressure loss for the grinding apparatus which is up to 40% lower, which results in a correspondingly high energy saving on the mill fan.

What is claimed is:

1. The method of crushing brittle material for subsequent grinding comprising:

(a) feeding brittle material into a grinding zone;

(b) grinding said material in said grinding zone;

(c) delivering adequately ground material to a sifting zone at a level above that of said grinding zone;

(d) delivering insufficiently ground material by gravity from said grinding zone to a crushing zone at a level below that of said grinding zone;

(e) roll crushing material in said crushing zone;

(f) conveying a selected proportion of crushed material from said crushing zone to said sifting zone for further sifting thereof; and (g) returning at least a portion of tailings from said sifting zone to said grinding zone for further grinding thereof.

2. The method of claim 1 including conveying a further portion of said tailings directly from said sifting zone to said crushing zone.

3. The method of claim 1 including disagglomerating said crushed material prior to sifting thereof.

4. The method of claim 1 including introducing a variably controlled air stream into said grinding zone to convey fines directly to said sifting zone thereby keeping power consumption of said grinding zone substantially constant.

5. The method of claim 4 including conveying a further portion of said tailings directly from said sifting zone to said crushing zone.

6. The method of claim 5 including disagglomerating said crushed material prior to sifting thereof.

7. Apparatus for crushing brittle material for subsequent grinding comprising:

a mill provided with means forming a rotating, horizontal grinding zone;

a sifter mounted above said mill and in communication therewith;

a roll mill in communication with said mill for receiving material therefrom which falls from said grinding zone; and conveying means between said roll mill and said sifter for delivering material from said roll mill to said sifter.

8. The apparatus of claim 7 including air stream delivery means in said mill for separating and delivering ground material to said sifter; and air stream control means for varying the operation thereof to maintain substantially constant the energy consumption of said mill.

9. The apparatus of claim 8 including tailings return means for returning a portion of the tailings separated by said sifter to said mill.

10. The apparatus of claim 9 wherein said sifter includes a rotating distributor plate located above a sifting zone; and drive means for said plate.

11. The apparatus of claim 10 wherein material delivery means is provided between said sifter and said roll mill to deliver a portion of the tailings separated by said sifter to said roll mill.

12. The apparatus of claim 11 including speed control means forming part of said material delivery means for regulating the proportion of tailings delivered to said roll mill.

13. The apparatus of claim 7 including material delivery means between said sifter and said roll mill for delivering a portion of the tailings separated by said sifter to said roll mill.

14. The apparatus of claim 13 including speed control means forming part of said material delivery means to regulate the proportion of tailings delivered to said roll mill.

* * * * *